US010197076B2

(12) United States Patent
Valentin-Rumpel

(10) Patent No.: US 10,197,076 B2
(45) Date of Patent: Feb. 5, 2019

(54) PNEUMATIC VOLUME BOOSTER

(71) Applicant: Samson Aktiengesellschaft, Frankfurt am Main (DE)

(72) Inventor: Frank Valentin-Rumpel, Gross-Umstadt (DE)

(73) Assignee: SAMSON AKTIENGESELLSCHAFT, Frankfurt am Main (DE)

( * ) Notice: Subject to any disclaimer, the term of this patent is extended or adjusted under 35 U.S.C. 154(b) by 224 days.

(21) Appl. No.: 15/235,560

(22) Filed: Aug. 12, 2016

(65) Prior Publication Data

US 2017/0204885 A1 Jul. 20, 2017

(30) Foreign Application Priority Data

Jan. 20, 2016 (DE) ..... 10 2016 100 919

(51) Int. Cl.
*F15B 13/04* (2006.01)
*F15B 15/20* (2006.01)
(Continued)

(52) U.S. Cl.
CPC ..... *F15B 15/204* (2013.01); *F15B 11/04* (2013.01); *F15B 13/0405* (2013.01); *F15B 5/006* (2013.01);
(Continued)

(58) Field of Classification Search
CPC ..... F15B 3/00; F15B 11/022; F15B 15/204
(Continued)

(56) References Cited

U.S. PATENT DOCUMENTS 2,296,647 A * 9/1942 McCormick ..... F01B 25/10 417/225
3,863,672 A * 2/1975 Theriot ..... F15B 13/0402 137/458
5,170,691 A * 12/1992 Baatrup ..... F04B 9/107 417/403
5,325,762 A * 7/1994 Walsh ..... F01L 23/00 251/65
(Continued)

FOREIGN PATENT DOCUMENTS

DE 102009015999 A1 10/2010
EP 1 653 132 A1 5/2006
(Continued)

*Primary Examiner* — Reinaldo Sanchez-Medina
(74) *Attorney, Agent, or Firm* — Schiff Hardin LLP

(57) ABSTRACT

A pneumatic volume booster to amplify a control pressure output signal can include a pneumatic control outlet for attachment to a pneumatic working chamber of the pneumatic actuator; a pneumatic aeration inlet configured to receive the pneumatic control pressure signal from the position controller, a pneumatic amplification inlet configured to receive a constant pneumatic air amplification signal, a pneumatic de-aeration connection from the control outlet to a pressure sink configured to aerate the control actuator, a deaerator seat-valve separating and/or opening the pneumatic de-aeration connection, a pneumatic aeration connection between the first aeration inlet and the control outlet; an aerator seat-valve separating and/or opening the pneumatic aeration connection, a pneumatic amplification connection between the amplification inlet and the control outlet; an amplification seat-valve separating and/or opening the pneumatic amplification connection; and a mechanical seat-valve-operator for commonly operating the de-aeration seat-valve, the first aerator seat-valve and the amplification seat-valve.

19 Claims, 3 Drawing Sheets

(51) Int. Cl.

| | |
|---|---|
| ***F15B 11/04*** | (2006.01) |
| *F15B 5/00* | (2006.01) |
| *F15B 11/10* | (2006.01) |

(52) U.S. Cl.
CPC ..... *F15B 11/10* (2013.01); *F15B 2013/0409* (2013.01); *F15B 2211/214* (2013.01); *F15B 2211/265* (2013.01); *F15B 2211/634* (2013.01); *F15B 2211/6336* (2013.01); *F15B 2211/8752* (2013.01)

(58) Field of Classification Search
USPC .. 137/489.5, 596.14, 596.15, 605, 606, 607, 137/625.6, 862
See application file for complete search history.

(56) References Cited

U.S. PATENT DOCUMENTS

| | | | | |
|---|---|---|---|---|
| 8,613,602 | B2 * | 12/2013 | Iversen ..... | F04B 9/1056 417/225 |
| 2008/0253906 | A1 * | 10/2008 | Strong ..... | F15B 15/202 417/321 |
| 2009/0283160 | A1 | 11/2009 | Fishwick et al. | |
| 2014/0026746 | A1 | 1/2014 | Lovell et al. | |

FOREIGN PATENT DOCUMENTS

| | | | |
|---|---|---|---|
| EP | 2 236 840 | A2 | 10/2010 |
| GB | 2 459 720 | A | 11/2009 |
| WO | 2012/037134 | A1 | 3/2012 |

* cited by examiner

PNEUMATIC VOLUME BOOSTER

CROSS REFERENCE TO RELATED APPLICATIONS

This patent application claims priority to German Patent Application No. 10 2016 100 919.9, filed Jan. 20, 2016, which is incorporated herein by reference in its entirety.

BACKGROUND

For large pneumatic actuators or drives with a pneumatic volume larger than or of at least approximately 2000 $cm^3$, it is desirable from a process-engineering point of view to realize a quick operation of a control valve to be controlled by the actuator, which, in the area of process-engineering, is commonly realized by deploying one or several so called pneumatic boosters or amplifiers. For each of these additionally connected boosters, additional pneumatic valves, such as quick exhaust valves, have to be deployed, in order to satisfy the operational requirements of the respective processing plant. The pneumatic connection of the boosters to the position controller and to the pneumatic actuator is cumbersome even by itself. Additionally it is difficult to set the respective individual operating characteristics of the device in the light of the desired positioning control when employing further pneumatic components.

The volume booster can be attached between a pneumatic position controller and a pneumatic control actuator having a control armature, such as a control valve, of a processing plant, and serves for aerating and/or for de-aerating, which shall for example operate a control valve of the processing plant. A processing plant serves for processing a process-technical fluid, such as petrochemical fluids, foodstuff-fluids, such as brewery-juices, in large scale.

German Patent Application Publication DE 10 2009 015 999 A1 describes a piloted pressure proportional valve. Upon a corresponding control, a volume stream amplification function can be attributed to the valve. The valve can include an electrically operable aeration valve and an electrically operable de-aeration valve, both of which are connected to a piloting chamber of the proportional valve, the piloting chamber being subjected to pressurized air. The pressure proportional valve includes a blocking function for the pneumatic actuator, when a predetermined actual working pressure falls below a predetermined desired working pressure, by closing the aeration valve and opening the de-aeration valve. Through pneumatically connecting both valves, the necessity for tubing is increased. Should further additional pneumatic amplifiers, such as boosters, be utilized, in order to supply a further volume stream amplification function to the pressure proportional valve, further valves would have to be included, which would have to be adapted to the desired control behavior of the position controller and which would thus increase the necessity for tubing even further.

In case of the very large volume pneumatic actuator (or drive), for example having a displacement volume of above 2000 $cm^3$, it is difficult to realize small pneumatic signal changes and large pneumatic signal changes, that is: to realize respective pressure changes, within the pneumatic working chamber of the pneumatic drive. For smaller positioning changes of the control valve to be controlled by the pneumatic control actuator, overshooting over the desired control position can occur due to friction forces and corresponding lengthy response time. In case of long control paths to be passed, this can lead to overshoot allowed by the large amounts of air present. In order to realize the correspondingly large amounts of air from a position controller into the pneumatic actuator, extra boosters can be deployed, which demand a cumbersome pneumatic connection. In case of a serial or parallel connection of multiple boosters, pneumatic signal deterioration has to be accepted, which requires complex and complicated adaptions of the control system due to different response characteristics and different dynamic behavior of the individual boosters.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Further features, characteristics and advantages of the disclosure will become apparent through the following description of a preferred embodiment of the disclosure on the basis of the enclosed drawings, in which is shown:

FIG. 1*a* illustrates a cross-sectional view of a pneumatic proportional valve according to an exemplary embodiment of the present disclosure in a first operating position (i.e. de-aerating).

FIG. 1*b* illustrates a cross-sectional view of the pneumatic proportional valve according to FIG. 1*a* in a further operating position (i.e., controlled aerating).

FIG. 1*c* illustrates a cross-sectional view of the pneumatic proportional valve according to the disclosure according to FIGS. 1*a* and 1*b* in a third operating position (i.e., the booster-operating position).

Figures 1A, 1B, 1C:
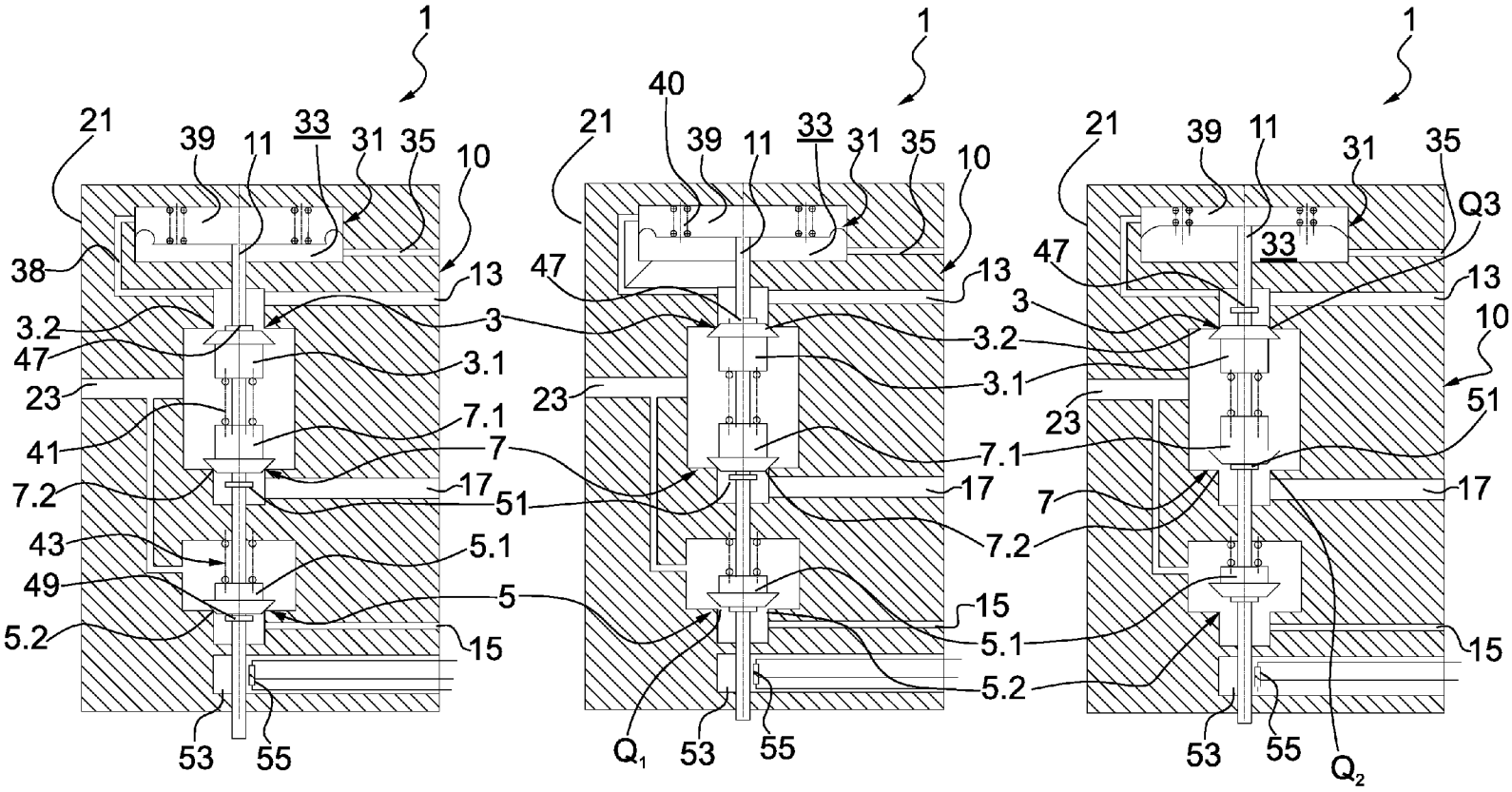

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

The disclosure relates to a pneumatic volume booster. The volume booster, which can also be called volume stream booster or volume stream amplifier, is deployed in conjunction with pneumatic position controllers, in order to together increase the positioning velocity of a pneumatic actuator and/or in order to spontaneously increase the displacement volume stream of the pneumatic actuator. The deployment of a volume booster in working conjunction with a position controller can be used when, for example, the position controller is not sufficient to realize the desired position control and thus the desired positioning actuator operation.

It is an objective of the disclosure to overcome the disadvantages of the prior art. For example, to provide a pneumatic volume booster that structural enhances a position controller, which is attached to a pneumatic actuator of a processing armature, or to provide an assembly including a position controller, the volume booster, and possibly the pneumatic actuator connected thereto, wherein the volume booster allows for a fast control of, for example, large pneumatic actuators preferably having a displacement volume of more than 2000 $cm^3$, wherein a complex and complicated control system adaption requirement and/or large constructive expensive of the tubing are to be avoided.

According to exemplary embodiments of the present disclosure, a pneumatic volume booster or pneumatic volume stream amplifier or servo valve device are described. The pneumatic volume booster or pneumatic volume stream amplifier or servo valve device can be configured to aerate and/or de-aerate (and, in some embodiments, additionally block) a pneumatic actuator, such as a pneumatic control actuator to operate a control armature, such as a control valve, of a processing plant, such as a petrochemical plant, a foodstuff processing plant, such as a brewery, or the like, is provided.

In an exemplary embodiment, the pneumatic volume booster stands in operating connection with a position controller transferring at least one pneumatic control signal via the volume booster to a pneumatic actuator, such as a pneumatic control actuator or pneumatic control drive. Exemplary embodiments of the disclosure can relate to both an assembly of the volume booster, the position controller and possibly the pneumatic actuator, as well to the volume booster as an attachable unit by itself. The pneumatic volume booster is, according to exemplary embodiments of the disclosure, deployed for large pneumatic actuators having a displacement volume of, for example, more than 2000 $cm^3$ and the displacement stroke velocity/stroke volume of which is to be increased. In an exemplary embodiment, the pneumatic volume booster is flanged as a compact pneumatic unit directly to the pneumatic actuator or can be fastened by other means or can be flanged or otherwise fastened to the position controller, in particular the housing thereof. In one or more exemplary embodiments, the pneumatic volume booster can include the one or more of the following functions and/or design elements:

A proportional 3/3-(5/3)-way valve being directly controlled by the position controller, wherein the working chamber of the pneumatic actuator is filled, bled, or closed via the 3/3-(5/3)-way valve;

A 2/2- or 4/2-way valve being mechanically coupled to the 3/3-(5/3)-way valve, wherein the 2/2- or 4/2-way valve is configured as a bypass valve for setting smaller volume streams;

A safety forcing means, such as a biasing spring, being mechanically coupled to the 3/3-(5/3)-way valve and possibly to the 2/2- or 4/2-way valve, wherein the safety forcing device is switchable via an additional safety-solenoid valve to force-bleed (force-de-aerate) the pneumatic actuator; and/or A displacement- or path-measurement of the position of the control valve of the control armature of the processing plant, wherein the measurement results are directly utilized for controlling the respective valve (s) of the pneumatic volume booster with the aid of the position controller electronics, of the position controller.

In an exemplary embodiment, the pneumatic volume booster is designed as a mounting unit with a compact housing structure which can be firmly attached close to the control actuator or close to the position controller. In an exemplary embodiment, the pneumatic volume booster, in particular the housing structure thereof, defines at least one pneumatic control outlet for attachment to at least one pneumatic working chamber of the pneumatic control actuator. In an exemplary embodiment, the housing structure of the pneumatic proportional valve (i.e.: the pneumatic volume booster) can also comprise a second or third pneumatic control outlet, for attaching to a second working chamber of the control actuator or to a further working chamber of further control actuator. Furthermore, at least a first pneumatic aeration inlet is configured in the housing structure of the volume booster, particularly for receiving a pneumatic control pressure signal, for example from a position controller. Furthermore, the pneumatic volume booster or pneumatic volume stream booster, in particular the housing structure thereof, has an amplification inlet for attachment or connection to a pneumatic supply source in particular of constant air pressure (e.g., 6 bar). A pneumatic amplification signal is received, such as a booster signal, for example from the pneumatic booster which can be interconnected between the amplification inlet and the position controller and which is connectable externally of the pneumatic volume booster, preferably the housing structure thereof.

In an exemplary embodiment, the pneumatic volume booster, (e.g., the housing structure thereof), can comprises a de-aeration opening. The opening can use atmospheric pressure to set the control outlet of the volume booster for a predetermined operation condition (e.g., an emergency operating condition) to atmospheric pressure and be de-aerated. Furthermore, the proportional valve according to the disclosure (e.g., integrated into the housing structure thereof) includes a pneumatic de-aeration channel connection between the de-aeration opening and the control outlet. In the de-aeration channel connection, a de-aeration seat-valve separating and/or opening the connection, which, in relation to other seat-valves of the volume booster, is dominantly controlling, such that, when opening the de-aeration seat-valve, a de-aerating of a control outlet is forced and thus the attached pneumatic working chamber of the pneumatic actuator can be de-aerated.

In an exemplary embodiment, a pneumatic aerating channel connection is formed between the aerating inlet and the control outlet within the housing structure of the volume booster. In the aerating or aeration channel connection, an aeration seat-valve separating and/or connecting the connection is arranged, which is suited for setting smaller changes of the amount of air for transfer to the pneumatic control outlet, via an (in relation to the volume booster) external upstream unit in order to ascertain a precise quality of control.

In an exemplary embodiment, the volume booster includes a pneumatic amplification connection between an amplification inlet or amplifier inlet and the control outlet. In the amplification channel connection, an amplification seat-valve is arranged separating and/or opening the connection, which is configured to switch on large changes of the amount of air (e.g., a predetermined switching-point), be realized by the mechanics of the volume booster. The amplification inlet of the volume booster can be connected via an external amplifier (booster) to a source of pressurized air of, for example, constant air pressure, such as 6 bar, so that large amounts of air can be switched on at a predetermined operating switching point, in order to abruptly provide larger control pressures (amounts of air) at the pneumatic control outlet for the pneumatic actuator.

In an exemplary embodiment, a common mechanical seat-valve operator is provided in the volume booster. The operator can be translationally moveable to the housing structure. In an exemplary embodiment, the seat-valve operator is configured to operate, the de-aeration seat-valve as well as the aeration seat-valve as well as the amplification seat-valve and to successively translocate them in order to create a controlled amount of air in relation to value at the timing within the pneumatic actuator. In an exemplary embodiment, several amplification seat-valves can be provided regarding multiple pneumatic amplification inlets in order to provide for different switching steps of aeration signals or switched on amplification signals.

In an exemplary embodiment, the volume booster can be used to realize diverse pressurization characteristics in the pneumatic actuator dependent on application and operation nearly without delay, wherein the structural effort for this remains low due to the common seat-valve operation. The possibility to provide an aeration valve and additionally an amplification valve for switching on additional air volume in just one valve enables variable modular construction systems for realizing most diverse aeration- and de-aeration-scenarios.

In an exemplary embodiment, the volume booster can also include an own position- or path-measurement in order to directly detect the position of the seat-valve operator for example of the amplification seat-valve and/or of the first aeration seat-valve to allow for transmission to the external position controller and to improve the quality of control.

In an exemplary embodiment, the volume booster significantly decreases the tubing effort for the different pneumatic control situations. The volume booster can provide large and small amounts quickly and safely using a valve mechanics, wherein for small KV-values (KV-value of the nominal displacement path), a bypass is provided.

In an exemplary embodiment, the proportional valve can be configured as a 3/3-way valve or as a 5/3-way valve. It is also possible that the proportional valve is configured as a 2/2- or 4/2-way valve.

In an exemplary embodiment of the disclosure, the common seat-valve operator has its own volume booster. The operator can be arranged within the housing structure of the volume booster and serve to operate the de-aeration valve, the aeration valve and the amplification seat-valve. Thereby, the membrane drive can be mechanically coupled to the aeration seat-valve, the de-aeration valve and to the amplification seat-valve. In an exemplary embodiment, the common seat-valve operator actuates (or operates) not simultaneously the de-aeration valve, the aeration valve and the amplification seat-valve, but dependent upon an operating member, which is translationally moveably mounted within the housing structure of the volume booster. The successive activation/deactivation of the respective seat-valve occurs dependent on the path of the position of the operating member. The succession of the operation of the aeration valve, the de-aeration valve and the amplification seat-valve enables on emergency shut down, for example by de-aerating or evacuating classical control of the actuator pressure within the control actuator, or the appropriate switching on of an amplifier (booster volume). The mechanical coupling of the common seat-valve of the operator can be configured such that the membrane drive runs free relative to each seat-valve in one respective displacement direction of the membrane drive and in an opposite displacement direction of the membrane drive, until it operates (e.g., carries upon reaching and exceeding a predetermined seat-valve-individual, drive-position) the respective seat-valve. Thereby, the displacement direction in which the membrane drive runs free, is not the same for all seat-valves. For example it is possible that in one of the two displacement directions, two of the at least three seat-valves are successively carried along and one remains unaffected, while in another displacement direction only one seat-valve can be carried and the other seat-valves remain unaffected.

In an exemplary embodiment, in a first displacement direction of the membrane drive, only the de-aeration-seat-valve runs free. The de-aeration-seat-valve can alternatively be rigidly coupled to the membrane drive that is operated in both displacement directions by the membrane drive free of play or without leeway. In this embodiment, both the aeration seat-valve and the amplification seat-valve are operable in the first displacement direction. This displacement direction can be referred to as a backward displacement direction. In a second displacement direction opposite to said first displacement direction of a membrane drive, the aeration seat-valve and the amplification seat-valve run free and the de-aeration seat-valve is operated by the membrane drive.

In an exemplary embodiment, the booster valve or amplification valve and the de-aeration valve can, as described above, run free in one displacement direction relative to the membrane drive, while in the other displacement direction these seat-valves (the aeration seat-valve and the amplification or second aeration seat-vale) will be carried. In an exemplary embodiment, the amplification valve is rigidly coupled to the membrane drive, such that the membrane drive carries the amplification valve in both displacement directions.

In an exemplary embodiment, the membrane drive is formed with a working chamber and a return chamber or bias chamber, where the return chamber can be operated pneumatically and/or be provided with a return spring or a bias spring. The working chamber and the return chamber are separated from one another by the membrane.

In an exemplary embodiment, the membrane drive receives from one further, separate pneumatic inlet, such as a membrane drive inlet, of the volume booster, a pneumatic inlet control signal, which preferably is created and/or controlled differently from the above-mentioned first pneumatic control signal, which is provided to the aeration inlet and comes from a position controller. In an exemplary embodiment, the pneumatic inlet control signal can also be a further pneumatic signal of the position controller, which is designed for emitting several different control signals. In an exemplary embodiment, the membrane drive is completely accommodated (or encased or housed) within a housing structure of the volume booster, wherein an operating rod or an operating shaft is coupled to the membrane separating the chambers in order to translationally or rotationally position the operating rod or shaft according to the pneumatic control signal. Insofar, the proportional-valve-owned membrane drive can be controlled directly through the pneumatic signal outlet of the position controller which is responsible for the control of the pneumatic actuator.

In an exemplary embodiment of the disclosure, the seat-valve operator includes an operating member, such as an operator rod or an operator shaft. The operating member can be directly driven by the membrane drive, wherein the operating member is structured to be free-running relative to the de-aeration seat-valve in one (backward) displacement direction and comprises an own carrier, which is for example formed as a ledge or step and can carry the de-aeration seat-valve in the other (forward) displacement direction. The carrier has the function to carry and thus to operate the respective seat-valve in only one of the two displacement directions. The de-aeration seat-valve can also be immovably fixed relative to the operating member.

In an exemplary embodiment of the disclosure, the mechanical seat-valve operator moves and opens from a predetermined de-aeration position corresponding to a membrane drive position at which the de-aeration valve is brought into a de-aeration position. Preferably, the de-aeration seat-valve, which is spring-biased into its closed position, is thereby brought out of its closed position. The spring bias for the de-aeration seat-valve serves to force the latter into the closed position. Only if the above-mentioned driving position or de-aeration position is reached by corresponding operation of the membrane drive, the seat-valve operator carries the de-aeration seat-valve along and causes it to leave its corresponding seat-valve.

In the opposite displacement direction, the common mechanical seat-valve operator moves the aeration seat-valve, which is responsible for the classical supply of pneumatic control signals to the pneumatic drive at a predetermined first closed position, which corresponds to a predetermined membrane drive position, directly into its closed position. The aeration seat-valve is spring-biased into the closed position, which particularly means that the aeration seat-valve is continuously forced by the spring-bias into its closed position. The common seat-valve operator urges the aeration seat-valve back into the closed position against the corresponding seat-valves.

The amplification seat-valve spring-biased into its closed position is urged out of its closed position and opens itself through the mechanical seat-valve operator from a predetermined opening position onwards. The spring-bias of the de-aeration seat-valve and of the amplification seat-valve can be formed by a common pressure spring, whereby the number of pressure-springs is decreased. The common pressure spring rests on one side on the de-aeration seat-valve to urge this into the closed position, and on the other hand rests on the amplification seat-valve to urge the latter into the closed position thereof. Respective carriers oriented equally with respect to the displacement direction of the seat-valve operator cause the opening of the respective seat-valve dependent upon how the successive carrier on the membrane drive of the seat-valve operator is realized.

In an exemplary embodiment of the disclosure, the seat-valve operator provides only (exactly) two diametrically opposite displacement directions (e.g., translational or rotational displacement directions). In an exemplary embodiment, the mechanical seat-valve operator is coupled to the seat-valves such that, upon a displacement in the first displacement direction (backward displacement direction):

a) The de-aeration seat-valve is moved from the forced closed position thereof by the mechanical seat-valve operator; and/or
b) The aeration seat-valve remains forced into its closed position; and
c) The amplification seat-valve remains unaffected by the seat-valve operator.

In an exemplary embodiment of the disclosure, the common seat-valve operator has exactly two diametrically opposite displacement directions, in particular translational or rotational displacement directions, wherein the mechanical common seat-valve operator is coupled to the seat-valves such that, upon displacement into a second displacement direction (forward displacement direction) opposite to the first displacement direction (backward displacement direction):

a) The amplification seat-valve and the aeration seat-valve are forced out of the respective closed position thereof through the mechanical seat-valve operator; and
b) The de-aeration valve remains unaffected by the seat-valve operator and remains urged into the closed position by a spring-bias, wherein the first and the second displacement direction are diametrically opposite to one another.

In an exemplary embodiment, the at least second pneumatic aeration inlet (the amplification inlet) and the de-aeration inlet connect with (mounds along a connecting channel) into a double-valve-chamber of the valve housing of the volume booster. In the double-chamber, the de-aeration seat-valve and the amplification seat-valve are mounted translationally moveable. From the double-valve-chamber, a control outlet channel extends towards the pneumatic control outlet. Additionally or alternatively, the pneumatic aeration inlet connects with (mounds into) a single-valve-chamber in which the first aeration seat-valve is mounted particularly translationally moveable and from which an intake channel extends into the control outlet channel, wherein the respective valve seats are realized by sections of the interior wall formed by the volume booster and/or formed by channels within the housing structure of the volume booster.

In an exemplary embodiment of the disclosure, a second pneumatic aeration inlet (the pneumatic amplification inlet) is provided in addition to the (first) pneumatic aeration inlet. Also a second aeration channel (the amplification channel) for a pneumatic connection between the further amplification inlet and the control outlet is formed within the housing structure of the volume booster. Within the aeration channel inlet, a further amplification seat-valve is integrated separating and/or opening the connection, in order to be connected to a first further amplifier unit (booster) or to a further position controller outlet. It shall be clear that one of the individual aeration inlets or amplification inlets can be attached to a booster. In order to assign a most comprehensive functionality comprising a type of operation with small and large changes of a mount of air or air volume to the proportional valve according to the disclosure, an aeration inlet is attached to a position controller, as well as the amplification inlet and the further amplification inlet to an amplifier unit, or to one respective amplifier unit each. The above-mentioned common seat-valve operator is configured to also operate the further aeration seat-valve and is correspondingly coupled thereto. The coupling with the further amplification seat-valve is configured equivalently relative to the desired operation of that of the (first) amplification seat-valve, but activatable in relation to the first amplification seat-valve with a displacement delay.

In an exemplary embodiment, the seat-valve operator has an operating rod or shaft, wherein the operating rod or shaft is mounted in particular translationally movable in a compact housing structure forming the control outlet as well as the aeration and/or amplification inlets. The volume booster can comprises a position sensor arranged within the compact housing structure of the volume booster adjacent to the seat-valve operator such that it can detect the position of the seat-valve operator. The position sensor can, for example, be realized as a Hall-element. In an exemplary embodiment, the position sensor is coupled to the position controller to forward the positioning information to the position controller, which can perform a control on the basis of the positioning signal. Insofar, the position controller can perform a control procedure without depending directly upon the position of a positioning rod for the control valve, but indirectly via the operating rod or shaft of the volume booster.

In an exemplary embodiment, the de-aeration seat-valve has a cone-shaped de-aeration valve body which cooperates with an associated de-aeration valve sealing seat, wherein the de-aeration valve body is spring-biased against the de-aeration valve sealing seat for closing the de-aeration seat-valve. Thereby, the de-aeration valve sealing seat can be realized by a section of the rigid housing structure of the proportional valve. In an exemplary embodiment, a pressure spring pushes the de-aeration valve body against the de-aeration valve sealing seat and thereby rests on an amplification valve body of the amplification seat-valve. Thereby, the pressure spring is configured to urge the de-aeration valve body and the amplification valve body against the de-aeration valve sealing seat and the amplification valve seat, respectively.

In an exemplary embodiment, the de-aeration seat-valve has a cone-shaped aeration valve-body, which is associated to a first aeration valve sealing seat. An own (individual) pressure spring is associated to the aeration valve body such that the aeration valve body is urged towards the aeration valve sealing seat and towards a carrier associated with the first aeration valve body of the seat-valve operator, wherein a mechanically releasable coupling between the common seat-valve operator and the aeration valve body is realized.

In one or more exemplary embodiments, a system can include a field device with the pneumatic volume amplifier or booster, a position controller, and a pneumatic actuator, wherein the pneumatic proportional valve is docketed (e.g., flanged) as a volume booster onto the housing of the pneumatic actuator to form a pneumatic coupling with a pneumatic control outlet, and/or the pneumatic volume booster is pneumatically coupled to corresponding outlets of the position controller to form a pneumatic couple with the respective aeration- and/or amplification-inlet. In an exemplary embodiment, the amplification inlet of the pneumatic proportional valve can be coupled pneumatically to a further outlet of the position control or to a pneumatic amplifier, such as a booster, to generate larger changes of the amount of air at the pneumatic control outlet of the proportional valve. The position controller and/or the pneumatic amplifier can be flanged on the exterior housing of the proportional valve according to the disclosure, or piping can be provided for pneumatically coupling the pneumatic components to the proportional valve.

In an exemplary embodiment, a system can include a field device assembly including a pneumatic volume booster, a position controller attached to the proportional valve, which transmits a pneumatic control signal (e.g., at a de-aeration inlet and at an aeration inlet) to the pneumatic proportional valve, and a pneumatic air booster attached to the pneumatic proportional valve, such as a booster, which is attached to the pneumatic volume booster via the amplification inlet. In embodiments where several aeration inlets and/or amplification inlets are be provided, an individual booster or position controller outlet can be attached for each of the inlets.

In an exemplary embodiment, an aeration cross-section for the first aeration seat-valve is smaller than the aeration cross-section of the at least second aeration seat-valve, the third and the following aeration seat-valves. In this way, a sensible control behavior of the pneumatic actuator shall be achieved. For opening multiple seat-valve cross-section, large amounts of air can be switched on for the pneumatic actuator, thereby achieving fast switching times.

Owed to the proportional valve unit or volume booster according to the disclosure, different valve applications with different amounts of air are usable without having to change the size of construction of the entire unit of the proportional valve.

In an exemplary embodiment, a mechanical pressure limitation can be provided at the second and third aeration seat-valve.

FIGS. 1*a* to 1*c* illustrate a volume booster or servo valve device 1 according to an exemplary embodiment of the present the disclosure. The volume booster 1 is a multiple-seat-valve device with a compact valve seat arrangement forming multiple valve seats, namely a de-aeration seat-valve 3, a first de-aeration seat-valve 5 and a second aeration seat-valve which can also be described as booster seat-valve or amplification seat-valve 7.

The three seat-valves 3, 5, 7 are accommodated in a common amplifier housing which can include one, two or multiple pieces, wherein each housing piece is rigidly coupled to the other housing pieces in order to form a housing unit. The respective seat-valves are configured to release or to restrict a pneumatic connection channel between a control outlet 23 and a respective inlet 15, 17, or exhaust 13, therefore, each seat-valve 3, 5, and 7 comprises a valve body 3.1, 5.1, 7.1 and a valve seat 3.2, 5.2, 7.2 stationary to the housing. The valve body is movable relative to the respective valve seat as explained below. Each seat-valve 3, 5, 7 is formed by a movable valve body as well as an associated valve seat, wherein each seat-valve can release an adjustable, seat-valve-individual throughlet cross-section (opening).

In an exemplary embodiment, at the de-aeration seat-valve 3, a cone-shaped de-aeration valve body 3.1 is provided, which cooperates with an associated de-aeration valve sealing seat 3.2. In an exemplary embodiment, at the aeration seat-valve 5 a cone-shaped aeration valve body 5.1 is provided which is associated to an aeration valve sealing seat 5.2. The booster seat-valve 7 has a cone-shaped booster valve body 7.1 associated to a booster valve sealing seat 7.2.

In an exemplary embodiment, the booster seat-valve 7 is arranged between the control outlet 23 and a second aeration inlet 17 (amplification inlet), to which a pneumatic amplifier, such as a booster (not shown in further detail) can be attached.

All three seat-valves 3, 5, 7, as explained above, define an adjustable and closable throughlet cross-section $Q_1$, $Q_2$, $Q_3$ adjustable by the valve body 3.1, 5.1, 7.1.

In an exemplary embodiment, as shown in FIGS. 1*a* to 1*c*, the valve sealing seats 3.2, 5.2, 7.2 are all formed by stationary housing sections which form the pneumatic volume booster 1 as one assembly unit. In an exemplary embodiment, the pneumatic conduits between the individual seat-valves 3, 5, 7 are realized by, for example, channels within the housing block structure. The respective valve sealing seats 3.2, 5.2, 7.2 are for example realized by the interior ledges relative to which the respective valve bodies 3.1, 5.1, 7.1 are movably mounted.

In an exemplary embodiment, as shown in FIGS. 1*a* to 1*c*, valve bodies 3.1, 5.1, 7.1 can be at least guided by an operating rod. In an exemplary embodiment, they are guided in a straight longitudinal control direction, and are at least partially operated thereby.

In the embodiment illustrated in FIGS. 1*a* to 1*c* of the pneumatic volume booster, one (1) booster seat-valve 7 is provided, but is not limited to only a single valve 7. It shall be clear, that also two, three or multiple amplification seat-valves or booster seat-valves 7 can be accommodated in the volume booster 1 which are activated or deactivated at different control positions of the operating rod 11, corresponding to the functioning of the booster seat-valve 7, as described in the row of FIGS. 1*a* to 1*c*. In case several booster seat-valves 7 are provided, these will be actuated displacement-delayed one after another depending on the position of the operating rod.

In an exemplary embodiment, due to the compact design of the volume booster 1 it is possible, to completely avoid exterior piping between the pneumatic drive, the pneumatic position controller, and the proportional valve, because the proportional valve 1 can be flanged immediately to the pneumatic actuator housing and/or to the position controller housing. In an exemplary embodiment, the block-like housing structure of the volume booster 1 has an inlet side that can also be described as its position controller side and to which a position controller (not shown in further detail) can be flanged. Thereby, the inlet side has an inlet terminal (or inlet diagram) which can correspond to the outlet terminal (or outlet diagram) of the position controller in a mirroring manner, to operate the respective inlets of the volume booster 1.

In an exemplary embodiment, the inlet side has a de-aeration opening 13, a first pneumatic inlet, namely an aeration inlet 15, which can be directly coupled to the supply 91 of the pressurized air or is to be attached to a pneumatic outlet signal $Y_2$ of the position controller 63 or is coupled to a further booster (67), as well as a second pneumatic inlet, namely an amplification inlet 17, which is directly coupled to the supply 91 of pressurized air (for example 6 bar) or which is connected to a pneumatic booster (not shown). The air pressure supply 91 as well as the pneumatic booster can be connected in series one after the other. Should several pneumatic amplifications, such as boosters, be provided, several amplification inlets and corresponding channels leading to valve seats can be provided. Finally, the inlet side 10 has a third pneumatic inlet, a membrane drive inlet 35, at which a pneumatic control outlet signal $Y_1$ can be received.

In an exemplary embodiment, the valve housing unit of the volume booster 1 according to the disclosure has an outlet side 21, that can also be referred to as drive side or actuator side, and to which the proportional valve 1 according to the disclosure can be attached to a pneumatic position controller (not shown in further detail). The outlet side has exactly one pneumatic control outlet 23, wherein also control outlets for the volume booster according to the disclosure can be provided.

Both the de-aeration opening 13 as well as the first pneumatic aeration inlet 15 as well as the second aeration inlet or first pneumatic amplification inlet 17 are connected via a respective pneumatic channel connection with the pneumatic control outlet 23, wherein the respective seat-valve 3, 5, 7 can separate or release the pneumatic channel connection.

In an exemplary embodiment, the volume booster 1 according to the disclosure has a common seat-valve operator acting upon all seat-valves 3 to 7 mechanically, in order either to avoid an actuation, to guide a displacement, or cause a displacement for instance by carrying. In an exemplary embodiment, a common seat-valve operator comprises a membrane drive 31 being arranged, when seen in the longitudinal direction, at one end of the housing unit of the volume booster 1. The membrane drive 31 can include a pneumatic working chamber 33 which is attached to a further pneumatic membrane drive inlet 35 on the inlet side 10. The working chamber 33 receives, via the membrane drive inlet, the pneumatic control signal $Y_1$, which is different from the control signal $Y_2$ delivered via the first pneumatic aeration inlet 15 to the proportional valve 1.

Figure 3:
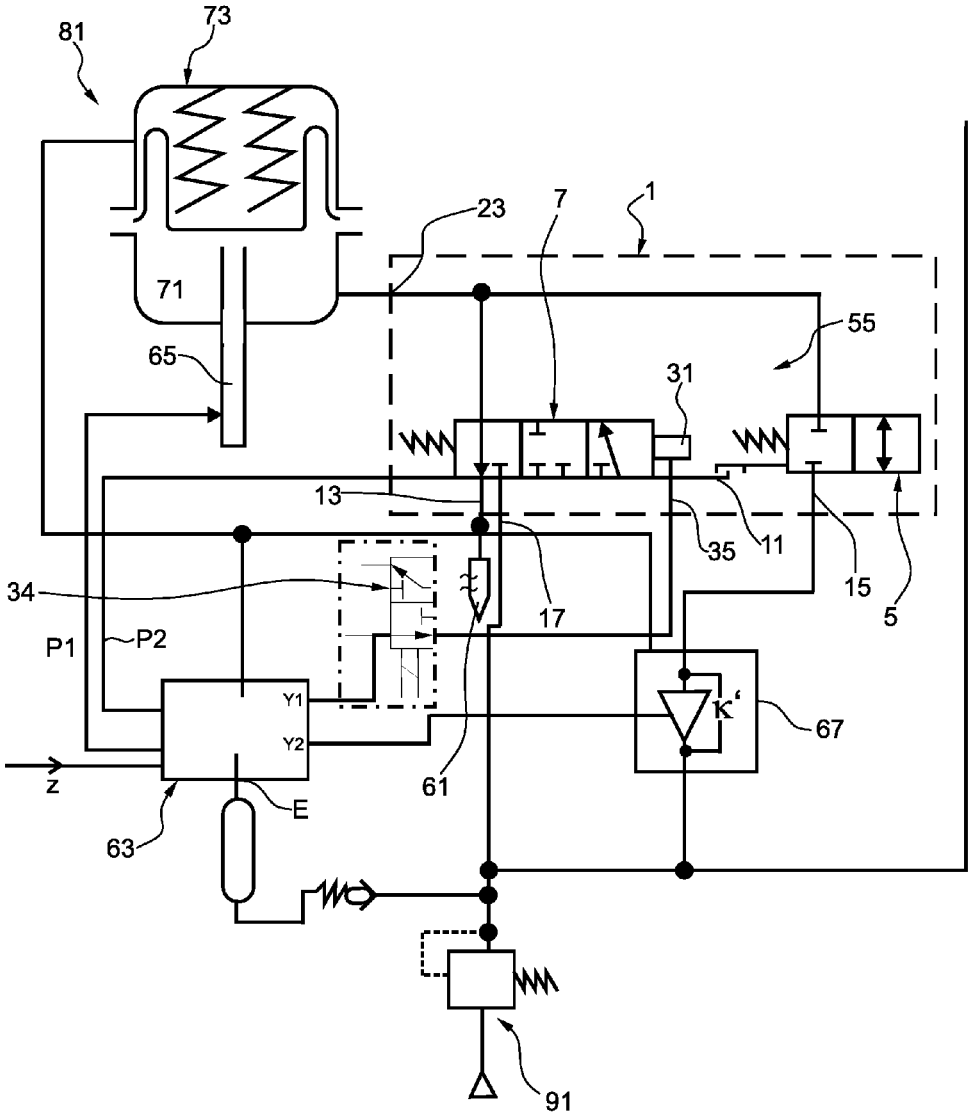
FIG. 3 illustrates a schematic view of a pneumatic proportional valve according to exemplary embodiments of the present disclosure integrated in a field device of a processing plant.

In an exemplary embodiment illustrated in FIG. 3, a separate safety valve 34 can be directly attached to the membrane drive inlet 35, wherein the pneumatic control signal $Y_2$ is supplied only to the aeration inlet 15. By means of the safety valve 34 the membrane drive inlet 35 and the working chamber 33 can be force-deaerated (forced venting). In this case, the drive spring 40 urges the operator rod 11 in direction $X_1$ so that the de-aeration seat-valve 3 is opened and the aeration seat-valve 5 and the amplification seat-valve 7 are closed. Consequently, the pneumatic control drive 73 drives the processing valve to be operated into a safety position.

In an exemplary embodiment, the membrane drive 31 furthermore has a (low pressure) return spring chamber 39, wherein also an exclusively pneumatically operated return chamber can be provided. In this case, a further drive inlet is provided, which is not included in the embodiment shown in FIGS. 1*a* to 1*c*. The return chamber 39 is pneumatically and the channel 38 coupled to the de-aeration opening 13.

As shown in FIGS. 1*a* to 1*c*, the membrane drive 31 can be formed with a membrane plate limiting the two working chambers 33 to which the control rod 11 is fastened, so that, depending on the pressurization of the working chamber 33, the control rod 11 can be linearly adjusted in the translational direction X. Thereby, one straight displacement direction (forward displacement direction) is designated $X_2$, wherein the opposite, straight displacement direction (backward displacement direction) shall be designated $X_1$.

In an exemplary embodiment, the de-aeration seat-valve 3 as well as the booster seat-valve 7 is spring-biased by a common pressure-spring in opposite displacement directions $X_1$ and $X_2$. The common compression spring pushes the valve body 3.1 either against the de-aeration sealing seat 3.2 or against a de-aeration carrier 47 stationary attached to the operating rod. The common compression spring pushes the booster valve body 7.1 against the associated booster sealing seat 7.2 or against the booster carrier 51. In the de-aeration operating condition shown in FIG. 1*a* of the volume booster 1, the de-aeration valve body 3.1 is forced against the de-aeration carrier 47 by the compression spring 41, while the booster valve body 7.1 is pushed against the booster sealing seat 7.2.

The valve body 3.1 is open, whenever the drive inlet 35 is de-aerated, wherein in this operating condition the aeration seat-valve 5 and the booster seat-valve 7 are closed. The common compression spring 41 rests on the one hand on the de-aeration valve body 3.1 and on the other hand on the amplification valve body 5.1.

In this operating condition (de-aeration condition according to FIG. 1*a*) the de-aeration valve body 5.1 is pushed by a compression spring 43 against the associated aeration sealing seat 5.2, wherein, as visible in FIG. 1*a* an aeration carrier 41, which is still slightly offset in displacement direction X is not yet arranged in a carrying engagement with the aeration valve body 5.1.

In an exemplary embodiment, the pressure spring 43 rests on the housing and on the aeration valve body 7.1 and urges the aeration valve body 7.1 into the backward displacement direction $X_1$.

The control rod 11 carries the de-aeration carrier 47 which can be configured as a protruding ledge. For the (first) aeration seat-valve 5, the first aeration carrier 49 is provided on the control rod 11. Finally, for the amplification seat-valve, the own booster carrier 51 is provided which cooperates with the valve body 7.1 of the amplification aeration seat-valve 7.

In an exemplary embodiment, the de-aeration carrier 47 is configured to carry the spring-biased valve body 3.1 of the de-aeration valve 3 from a closed position, as indicated in FIG. 1*a*, in order to direct pneumatically connect the de-aeration opening 13 with the control outlet 23 and thereby de-aerate the pneumatic actuator. During the displacement of the control rod 11, upon a corresponding receipt of a de-aeration signal in the working chamber 33 via the de-aeration inlet 13, the membrane drive compression springs 40 urge the control rod 11 into the backward displacement direction $X_1$, such that the de-aeration carrier 47 carries the valve body 3.1 such that the de-aeration coupling between the de-aeration opening and the control outlet 23 is realized.

In the following, the aeration operating condition will be described particularly based upon FIG. 1*b:*

In an exemplary embodiment, when pressurizing the working chamber 33 of the membrane drive 31 with a corresponding pneumatic control signal from a position controller not shown in further detail (in FIG. 1*b*) via the drive inlet 35, the control rod 11 is displaced in the forward displacement direction $X_2$ (upwards) which is caused by the compression spring 41. The de-aeration valve body is pushed by the common compression spring 41 against the de-aeration carrier 47 until the de-aeration valve body 3.1 engages into a sealing contact with the de-aeration sealing seat 3.2 such that the de-aeration seat valve 3 is closed. The de-aeration condition of the pneumatic drive is finished.

By displacing the control rod 11 in forward displacement direction $X_2$ a displacement in this forward displacement direction $X_2$ for the aeration valve body 5.1 goes along so that the aeration seat-valve is opened. The throughlet cross-section $Q_1$ determines the strength of the pneumatic outlet signal at the control outlet 23 with which the pneumatic control actuator is operated.

In case of a strong control pressure signal in the pneumatic working chamber 33 of the membrane drive 31, the control rod 11 is significantly displaced in forward displacement direction $X_2$, such that also the valve body 7.1 of the amplification seat-valve 7 is opened, thereby providing the pneumatic amplification signal released via the amplification inlet 17 to the control outlet 33. In this way a significant pneumatic volume stream increase is provided for the pneumatic control actuator.

In an exemplary embodiment, the volume booster 1 includes a sensor 55 arranged (or accommodated) in a hollow space 53 and which can detect the position of the control rod 11 contact-free.

Figure 2:
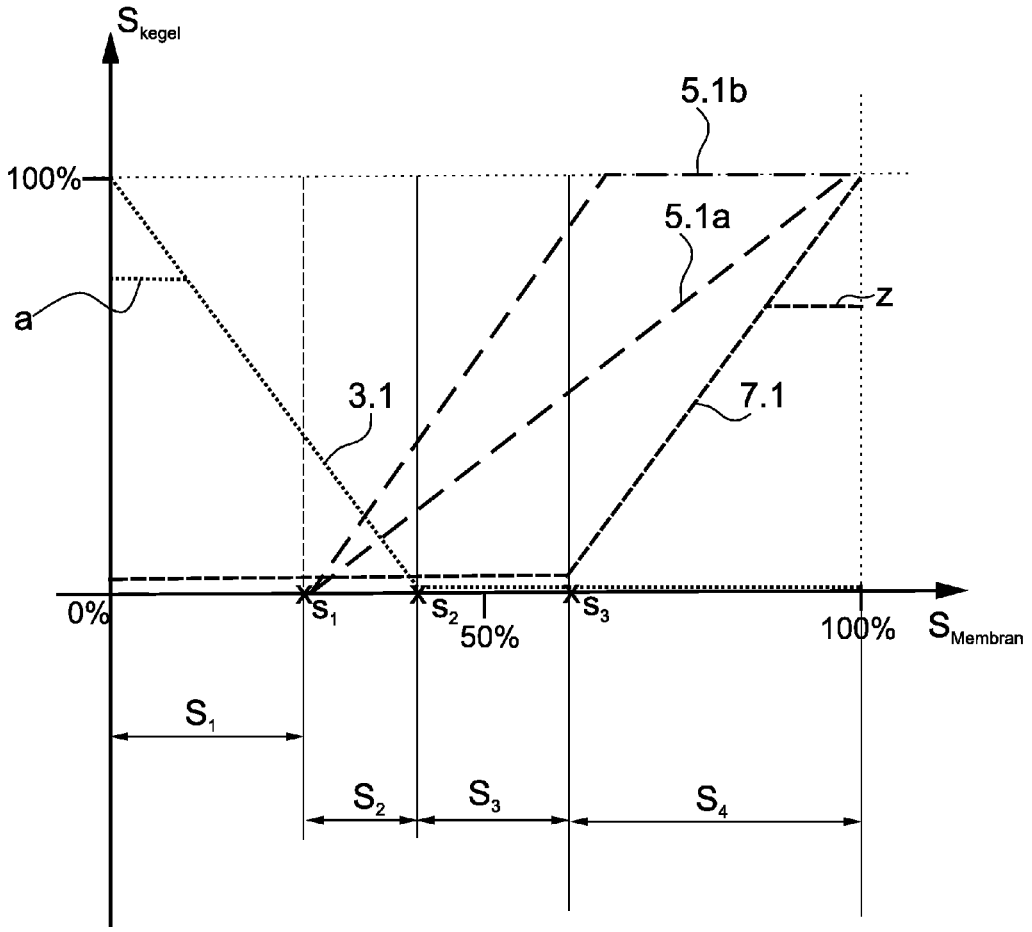
FIG. 2 illustrates a functional diagram of the different operating positions of the pneumatic proportional valve according to exemplary embodiments of the disclosure.

FIG. 2 illustrates a working principle of the proportional valve according to an exemplary embodiment of the disclosure. FIG. 2 includes a diagram that shows the servo amplifier function of the volume stream booster.

The abscissa (e.g., x-axis) of the diagram shows the control displacement of the membrane drive with $S_{Membran}$ between 0% (de-aeration) and 100% (full aeration). The ordinate axis shows the replacement of the respective valve body 3.1, 5.1 or 7.1 of the de-aeration seat-valve 3, of the aeration seat-valve 5 and of the booster seat-valve 7. The different interrupted characteristic lines show the displacement of the respective valve body 3.1, 5.1, 7.1. The dotted line indicates the displacement of the de-aeration valve body 3.1 depending on the control displacement of the membrane drive $S_{Membran}$. The short-dashed-line shows the displacement of the booster valve body 7.1 depending on the displacement of the membrane drive. The long-dashed-lines show two variants for aeration seat-valves 5 of two different concepts.

Along the control path $S_1$, the aeration valve 3 is gradually closed, which is being displaced from the 100% opened position to the 0% closed position. At $S_1$ the de-aeration valve 3 is not yet quite closed, however, the aeration seat-valve 5 begins to become active and to supply a volume stream into the control outlet. Thereby, a quick opening movement (5.1*b*) or a lower opening velocity (5.1*a*) can be realized, depending on the configuration of the aeration seat-valve 5, which shall be emphasized by the two long-dashed lines 5.1*a*, 5.1*b*. Within the control path range $S_2$ the booster seat-valve is (still) inactive. In this control path range $S_2$ small amounts of air are supplied to the control outlet 23 such that a precise displacement without risk of overshooting is achieved.

Along the control path section $S_2$ the de-aeration valve is still open. After exceeding the control path region $S_2$, the de-aeration valve 3 is permanently closed. In a preferred embodiment of the disclosure, the de-aeration seat-valve 3 is configured such it will not drive in the 100% opened position, but such that the de-aeration carrier 47 is placed so it cannot fully open the de-aeration valve body 3.1. Consequently, the de-aeration valve body 3.1 cannot reach the 100% position which shall be indicated by the control path course a. In this way, an operation of the de-aeration seat-valve 3 shall be avoided.

From the control path $S_2$ to the end of the control path range $S_3$, only the aeration valve 5 is opened so as to communicate the control pressure at the control outlet 32 to the not illustrated control actuator. According to the quick opening movement (5.1*b*), the aeration seat-valve 5 moves in this range between 40% and 90% of the fully opened position. According to the quick opening movement (5.1*a*), the aeration seat-valve 5 moves in this range between 40% and 90% of the fully opened position. By constructively setting the aeration seat-valve 5, the aeration volume can be set within the control path range $S_3$ while not requiring a change of pneumatics of the upstream position controller. In this way, a standardized position controller can individually be individualized according to the specification of the control actuator and/or particularities of the operation.

In an exemplary embodiment, in order to enable a quick switching on of a control pressure for the pneumatic drive, starting at the control path $S_3$ at approximately 60% of the control path ($S_{Membran}$) of the control rod 11 in the forward controlled displacement direction $X_2$, a booster air addition (7.1) is activated. The position controller 63 with the booster air addition can achieve an abrupt increase of the volume stream and of the volume pressure within the control path range $S_4$ different from the continuous change of aeration.

For limiting the booster aeration and thus preventing damage to the booster seat-valve and to the control actuator, a limit (range Z), (position of the carrier 51) can be provided for the booster valve 7, which avoids a complete opening of the booster seat-valve body 7.1.

The control paths $S_1$, $S_2$, $S_3$, $S_4$ and the transitions from de-aerating to aerating as well as between aerating and amplifying, whether succeeding one after another or including overlap, can be set by the design, dependent on how the membrane drive stroke and the carriers 47, 51, 49 cooperate and are on how they are adapted to the characteristic valve line.

FIG. 3 illustrates a field device 81 or a field device assembly according to an exemplary embodiment of the disclosure that includes the volume booster 1. The structural border of the proportional valve 1 is indicated with a dotted line and formed by the housing structure which defines the inlets/openings 13, 15, 17, 23 and 35, as they are designated and which is not shown in further detail in FIG. 3 above. The housing structure can be flanged to a different, separate housing structure, for example of the position controller 63, of the control actuator 73, or of the control armature 65 of the field device 81, such that a pneumatic pipe connection between the position controller 63 and the volume booster 1 is omitted.

In this example, the volume booster 1 includes the de-aeration valve 3, the aeration or control seat-valve 5, and the booster seat-valve 7, wherein the driving spring 40 is also indicated. The de-aeration opening 13 is attached to an atmospheric pressure sink 61. The aeration or control inlet 35 is attached to a control outlet $y_1$ of the position controller 63, which receives a desired control signal t from a control room (not shown in detail). Additionally, the position controller 63 receives position data $p_1$ regarding the position of the control armature, which is operated by a control actuator rod 65 by the control drive 73. Furthermore, the position controller 63 receives position data $p_2$ from a sensor 55 which scans the operating rod 11 of the membrane drive 31 of the volume booster 1. The position controller 63 has a second pneumatic outlet via which the further pneumatic control signal $Y_2$ is transferable, which can be created and controlled completely independently from the pneumatic control outlet signal $Y_1$ emitted at the outlet, and with which further pneumatic control signal $Y_2$ the pneumatic amplifier (booster) 67 is controlled. In an exemplary embodiment, the position controller 63 includes processor circuitry configured to perform one or more of the functions and/or operations of the position controller 63.

In an exemplary embodiment, the position controller 63 can include multiple pneumatic control outlets $Y_1$. For example, as realized in a position controller as described in German Patent Application publication DE 10 2012 021 387.5, which is incorporated herein by reference in its entirety.

In an exemplary embodiment, the pneumatic amplifier 7 has the amplification characteristic κ which adds a pneumatic amplification signal via the amplification inlet 17 to the volume booster 1. The pneumatic control outlet 23 is connected to a control drive chamber 71 of the pneumatic control drive 73 which acts upon a control valve, which is not shown in further detail of the processing plant by means of the control rod 65.

When the safety valve 34 switches, the membrane drive inlet 35 is then vented (de-aerated), wherein due to the drive springs 40 of the membrane drive 31, the de-aeration through the de-aeration seat-valve 3 is caused.

The safety valve 34 can cause the de-aeration of the membrane drive 31 and thus of the volume booster 1 and thereby of the control actuator 73 in order to achieve a quick and independent switching into the safety position.

In an exemplary embodiment, in a first operating condition, in which the de-aeration signal is present on the membrane actuator inlet 35, the drive springs 40 and the membrane drive 31 push the plate membrane onto which the operating rod 11 is fastened into the backward displacement direction $X_1$ so that the de-aeration valve 3 is carried out of its closed position and opened (FIG. 1*a*). The control outlet 23 is exposed to the atmospheric pressure via the de-aeration openings 13 such that the pneumatic control actuator 73 is directly pneumatically coupled to the pressure sink 61.

Should no de-aeration signal be present at 35, a controlled controlling signal (having a small amount of air) is provided from the position controller 63 to the aeration inlet 35 in accordance with a second operating condition. The de-aeration valve 3 closes against the drive springs of the membrane drive 31. Due to the displacement of the actuator rod 11 in forward displacement direction $X_2$, the first aeration seat-valve 5 opens, such as shown in FIG. 1*b*, so that the pneumatic control outlet 23 is exposed with a position control pressure which is defined by the characteristics of the volume booster 1 and transferred to the pneumatic working chamber 71 of the control actuator 73. Via a further, separate pneumatic control signal $Y_2$, the additional booster 67 can for example be activated. With a further displacement of the operator rod 11 in the forward displacement direction $X_2$, the amplification seat-valve 7 will now also be opened. In this way, large amounts of air are delivered to the pneumatic control outlet 23.

In one or more exemplary embodiments of the present disclosure, it is possible to flexibly set an emergency de-aeration (emergency venting), a control aeration, and a booster aeration using a mechanical pneumatic unit without electronic components in the proportional valve operation. In an exemplary embodiment, only a single electronic component in form of the position sensor that detects the position of the seat-valve operator is provided. Further electronic components, for switching the pneumatic amplifier and of the control aeration, are obsolete with the volume booster 1 according to one or more exemplary embodiments of the disclosure. In an exemplary embodiment, further electronic components, such as a limit switch, for example a Reed-contact, can be attached in order to signal the occupation of the safety position or emergency position. Also, a separate, certified control signal can be emitted in order to diagnose the safety function of the volume booster separately for example via a Partial-Stroke-Test (PST).

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

For the purposes of this discussion, processor circuitry can include one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein. In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 volume booster
3 de-aeration seat-valve
3.1 de-aeration valve body
3.2 de-aeration valve seat
5 aeration seat-valve
5.1 aeration valve body
5.2 aeration valve seat
7 booster seat-valve
7.1 booster valve body
7.2 booster valve seat
10 inlet side
11 operating rod
13 de-aeration opening
15 aeration inlet
17 aeration inlet
21 outlet side
23 control outlet
31 membrane drive
33 working chamber
34 safety valve
35 membrane drive inlet
39 return spring chamber
40 drive spring
41, 43 compression spring
47 de-aeration carrier
49 aeration carrier
51 booster carrier
53 hollow space
55 position sensor
61 pressure sink
63 position controller
65 control armature
67 booster
71 control drive chamber
73 pneumatic control drive
81 field device
91 supplier
κ amplification characteristic
$p_1$, $p_2$ position data
$Y_1$, $Y_2$, $Y_i$ pneumatic outlet (signal)
$Q_1$, $Q_2$, $Q_3$ throughlet cross-section
$X_1$ backward displacement direction
$X_2$ forward displacement direction
a, z control path limit
t control position signal

The invention claimed is:

1. Pneumatic volume booster for amplifying a pneumatic control pressure output signal of a position controller which aerates and/or de-aerates a pneumatic actuator, for actuating a control armature of a processing plant, the booster comprising:

a pneumatic control outlet for attachment to a first pneumatic working chamber of the pneumatic actuator;

a pneumatic aeration inlet configured to receive the pneumatic control pressure signal from the position controller, at least one pneumatic amplification inlet configured to receive a constant pneumatic air amplification signal, a pneumatic de-aeration connection from the control outlet to a pressure sink configured to aerate the control actuator, a deaerator seat-valve separating and/or opening the pneumatic de-aeration connection, a pneumatic aeration connection between the pneumatic aeration inlet and the control outlet;

an aerator seat-valve separating and/or opening the pneumatic aeration connection, a pneumatic amplification connection between the pneumatic amplification inlet and the control outlet;

an amplification seat-valve separating and/or opening the pneumatic amplification connection; and a mechanical seat-valve-operator for commonly operating the de-aeration seat-valve, the first aerator seat-valve and the amplification seat-valve.

2. The pneumatic volume booster according to claim 1, wherein the common seat-valve-operator comprises a membrane drive that is mechanically coupled to the de-aeration seat-valve, the first aeration seat-valve, and the amplification seat-valve, wherein the mechanical coupling is configured such that the membrane drive can run free relative to each seat-valve in a displacement direction of the membrane drive and such that in an opposite displacement direction of the membrane drive, and upon reaching and exceeding a predetermined drive position of the membrane drive, operates the respective seat-valve, wherein in a forward displacement direction of the membrane drive, the de-aeration seat-valve runs free and the aeration seat-valve and the amplification seat-valve are operable by the membrane drive, and wherein, while in a backward displacement direction of the membrane drive opposite to the forward displacement direction, the aeration seat-valve and the amplification seat-valve run free and the de-aeration seat-valve is operable by the membrane drive.

3. The pneumatic volume booster according to claim 2, wherein the membrane drive comprises a second pneumatic working chamber and a return chamber, wherein the membrane drive is configured to receive a pneumatic control signal via a pneumatic membrane drive inlet different from the pneumatic aeration inlet and the pneumatic amplification inlet, the pneumatic control signal controlling the membrane drive to switch the volume booster into a respective operation, and wherein a switching point of a switching on of an air amplification is realized by activation of the amplification seat-valve.

4. The pneumatic volume booster according to claim 3, wherein the activation of the amplification seat-valve comprises engagement of the seat-valve operator with the amplification seat-valve.

5. The pneumatic volume booster according to claim 3, wherein the membrane drive is accommodated within a closed housing structure of the pneumatic booster, wherein an operating rod is coupled to a membrane separating the second pneumatic working chamber and the return chamber of the membrane drive to control the operating rod in a translational movement direction based on the pneumatic control signal from the position controller received via the pneumatic membrane drive inlet.

6. The pneumatic volume booster according to claim 5, wherein the operating rod is mounted moveable longitudinally in the displacement direction to the housing structure.

7. The pneumatic volume booster according to claim 1, wherein the common seat-valve-operator comprises an operator member that is actuated by the membrane drive, wherein the operator member is structured to be free running in a displacement direction relative to the aerator seat-valve and the amplification seat-valve, and comprises an operator-member-fixed carrier associated with the aerator seat-valve and the amplification seat-valve to carry each respective seat valve in only the displacement direction or an opposite displacement direction that is opposite the displacement direction.

8. The pneumatic volume booster according to claim 7, wherein the operator member comprises an operating rod or an operating shaft.

9. The pneumatic volume booster according to claim 1, wherein the common mechanical seat-valve-operator carries:

the de-aeration seat-valve from its closed position and opens the de-aeration seat-valve, the aeration seat-valve from its closed position and opens the aeration seat-valve, and/or the amplification seat-valve from its closed position and opens the amplification seat-valve, wherein the respective carrying of the de-aeration seat-valve, of the aeration seat-valve and/or of the amplification seat-valve is based on a displacement path of the mechanical seat-valve operator, and wherein a spring-bias of the de-aeration seat-valve and of the amplification seat-valve is provided by a common pressure spring, which rests against on the de-aeration seat-valve and rests on the amplification seat-valve.

10. The pneumatic volume booster according to claim 9, wherein:

the de-aeration seat-valve is biased into its closed position, the aeration seat-valve is biased into its closed position, the amplification seat-valve is biased into its closed position, and a spring-bias of the de-aeration seat-valve and of the amplification seat-valve is provided by a common pressure spring that rests against the de-aeration seat-valve and the amplification seat-valve.

11. The pneumatic volume booster according to claim 1, wherein the seat-valve-operator comprises only two diametrically opposite displacement directions, the common mechanical seat-valve-operator being coupled to the de-aeration seat-valve, the aerator seat valve, and the amplification seat valve such that in a displacement in a first displacement direction of the two diametrically opposite displacement directions:

a) only the de-aeration seat-valve is displaced from its forced closed position by the mechanical seat-valve-operator; and/or b) the aerator seat valve is forced into its closed position; and c) the amplification seat valve is forced into its closed position.

12. The pneumatic volume booster according to claim 11, wherein the common mechanical seat-valve operator is coupled to the de-aeration seat-valve, the aerator seat valve, and the amplification seat valve such that a displacement in a second displacement direction of the two diametrically opposite displacement directions:

a) the amplification seat-valve is displaced by the mechanical seat-valve operator from its forced closed position; and/or b) the first aerator seat-valve is displaced by the mechanical seat-valve operator from its forced closed position; and c) the deaerator seat-valve runs free and unaffected by the seat-valve operator, wherein the first and second displacement directions are opposite to one another.

13. The pneumatic volume booster according to claim 1, wherein:

the pneumatic amplification inlet and the de-aeration outlet extend along a respective connection channel into a double-valve chamber of the valve housing structure of the volume booster, a common control outlet channel extending from double-valve chamber the pneumatic control outlet, both the de-aeration seat-valve and the amplification seat-valve are mounted moveable in a displacement direction, and/or the pneumatic aeration inlet connects with a single-valve-chamber in which single-valve-chamber the aeration seat-valve is moveably mounted and from which an intake channel extends to the control outlet, wherein respective valve seats of the de-aeration seat-valve, the aeration seat-valve, and the amplification seat-valve are formed by a housing interior wall of the respective valve chamber, and/or the respective channels are formed in a housing block structure of the volume booster.

14. The pneumatic volume booster according to claim 1, further comprising:

a further pneumatic amplification inlet and a further amplification seat-valve, which separates and/or opens a pneumatic amplification connection between the further pneumatic amplification inlet and the control outlet, wherein the common seat-valve-operator is configured to also actuate the further amplification seat-valve, the further amplification seat valve being mechanically configured corresponding to the coupling to the amplification seat-valve.

15. The pneumatic volume booster according to claim 1, wherein the common seat-valve operator comprises an operating rod or operating shaft, wherein:

the operating rod or operating shaft is moveably mounted translational in a displacement direction in a compact housing structure forming the control outlet the pneumatic aeration inlet and the pneumatic amplification inlet, and/or a position sensor is provided, the position sensor being configured to detect a position of the common seat-valve operator, wherein the position sensor is connected to the position controller to supply positioning information of the common seat-valve operator.

16. The pneumatic volume booster according to claim 1, wherein the deaerator seat-valve comprises a cone-shaped de-aeration valve body that is translationally moveably mounted relative to a rigid housing structure of the volume booster, and which sealingly or releasingly interacts with an associated de-aeration valve sealing seat, wherein:

the de-aeration valve body is spring-biased against the de-aeration valve sealing seat to close the de-aeration seat-valve, the de-aeration valve sealing seat is realized by a section of the rigid housing structure of the volume booster, a pressure spring is configured to urge the de-aeration valve body against the de-aeration valve sealing seat and rests against an amplification valve body of the amplification seat-valve, the amplification valve body being translationally moveably mounted relative to the housing structure of the volume booster, and the pressure spring is configured to urge the de-aeration valve body and the amplification valve body against the de-aeration valve sealing seat or the amplification valve sealing seat.

17. The pneumatic volume booster according to claim 1, wherein the aeration seat-valve comprises a cone-shaped aeration valve body that is translationally mounted relative to a housing structure of the volume booster, the aeration valve body being associated with a aeration valve sealing seat, wherein a pressure spring is associated with the aeration valve body such that the aeration valve body is urged against the aeration valve seat or against a carrier associated to the aeration valve body of the seat-valve operator.

18. A field device comprising:

the pneumatic volume booster according to claim 1, wherein:

the volume booster is pneumatically coupled to the position controller via the pneumatic control outlet of the position controller, the pneumatic volume booster is coupled to at least one constant pressure supply source via a booster, the pneumatic volume booster is attached externally to a housing of the pneumatic actuator to form a pneumatic coupling to the pneumatic control outlet, and/or the pneumatic volume booster is pneumatically coupled to corresponding outlets of the position controller to respectively pneumatic couple with the pneumatic aeration inlet and/or the pneumatic amplification inlet.

19. A field device assembly device comprising:

the pneumatic volume booster according to claim 1, wherein:

the position controller is attached to the volume booster, the position controller being configured to provide a pneumatic control pressure output signal to the pneumatic volume booster via a pneumatic membrane drive inlet and the pneumatic aeration inlet, and an air amplification connected to the pneumatic volume booster via the pneumatic amplification inlet.

* * * * *